US012385213B2

(12) United States Patent
Tevis et al.

(10) Patent No.: US 12,385,213 B2
(45) Date of Patent: Aug. 12, 2025

(54) SYSTEMS AND METHODS FOR IDENTIFYING WEAR ON GRADING MACHINE

(71) Applicant: Caterpillar Inc., Peoria, IL (US)

(72) Inventors: Ethan M. Tevis, Bloomington, IL (US); Michael C. Gentle, Maroa, IL (US); Brandon L. Hagman, Brimfield, IL (US)

(73) Assignee: Caterpillar Inc., Peoria, IL (US)

( * ) Notice: Subject to any disclaimer, the term of this patent is extended or adjusted under 35 U.S.C. 154(b) by 717 days.

(21) Appl. No.: 17/656,270

(22) Filed: Mar. 24, 2022

(65) Prior Publication Data

US 2023/0304257 A1 Sep. 28, 2023

(51) Int. Cl.

| | |
|---|---|
| ***E02F 3/84*** | (2006.01) |
| ***E02F 9/26*** | (2006.01) |
| ***E02F 9/28*** | (2006.01) |

(52) U.S. Cl.

CPC ..... *E02F 3/845* (2013.01); *E02F 9/265* (2013.01); *E02F 9/2883* (2013.01)

(58) Field of Classification Search

CPC ..... E02F 3/845; E02F 9/265; E02F 9/2883; E02F 9/264; E02F 9/267; E02F 9/2816; E02F 9/24; E02F 9/2833

See application file for complete search history.

(56) References Cited

U.S. PATENT DOCUMENTS

| | | | | |
|---|---|---|---|---|
| 10,262,411 | B2 | 4/2019 | Kean | |
| 10,697,154 | B2 | 6/2020 | Bewley et al. | |
| 10,787,792 | B2 | 9/2020 | Carpenter et al. | |
| 11,788,925 | B1 * | 10/2023 | Hawkins | E01H 5/061 702/34 |
| 2017/0372534 | A1 * | 12/2017 | Steketee | E02F 9/2054 |
| 2018/0205905 | A1 * | 7/2018 | Hammar | G09B 9/042 |
| 2020/0362542 | A1 | 11/2020 | Veasy et al. | |
| 2021/0047807 | A1 | 2/2021 | Gray et al. | |

* cited by examiner

*Primary Examiner* — Christopher J Sebesta
*Assistant Examiner* — Robert E Pezzuto

(57) ABSTRACT

A method for detecting wear in an implement system of a grading machine includes receiving acceleration information from a sensor connected to the implement system while the grading machine performs a task and estimating an incremental amount of wear in the implement system of the grading machine based on the acceleration information. The method also includes determining a cumulative amount of wear in the implement system of the grading machine and outputting a notification based on the cumulative amount of wear.

20 Claims, 4 Drawing Sheets

SYSTEMS AND METHODS FOR IDENTIFYING WEAR ON GRADING MACHINE

TECHNICAL FIELD

The present disclosure relates generally to a grading machine, more particularly, to systems and methods for identifying a worn or loose blade of a grading machine.

BACKGROUND

Grading machines, including motor graders and tractors, include a cutting implement, such as a blade, that manipulates material on a worksite. The blade facilitates the placement of soil or other materials, in part due to the ability of the operator to position the blade as desired. The blade, connected to a frame of the machine, moves and levels material to provide a surface having a particular height and inclination. By necessity, the blade operates in a harsh environment and is subject to strong, sudden forces. Due to this, blades and other ground-engaging implements wear at a relatively fast rate, the rate of wear being affected by factors such as the type of material encountered by the blade, the position of the blade and associated components, and the speed at which the machine travels, among others. While the cutting edge of the blade itself wears over time, other components of the implement system for the blade also wear, and require periodic maintenance. Regular inspection, maintenance (e.g., adjustment), and replacement of the blade and implement system is necessary to support optimal performance of the grading machine. However, even with regular maintenance, it is possible that wear or damage to the implement system will be overlooked, especially when the implement wears or loosens more quickly than expected, or is improperly installed.

A system for measuring wear in a blade for a motor grader is described in U.S. Patent Application Publication No. 2020/0362542 ("the '542 publication") to Veasy et al. The system in the '542 publication evaluates wear by setting the blade on the ground. While the blade is on the ground, the system can evaluate wear on a cutting edge of a blade due to the position of the blade, in comparison to a previous measurement, also taken while the blade was placed on the ground. While the system of the '542 publication may be useful for measuring wear of a blade, the system relies on detection of the position of a blade itself to make this measurement. The system described in the '542 publication is therefore unable to evaluate wear on components of the implement system other than the blade, or to identify wear as it occurs (e.g., in real-time or near real-time manner).

The systems and methods of the present disclosure may solve one or more of the problems set forth above and/or other problems in the art. The scope of the current disclosure, however, is defined by the attached claims, and not by the ability to solve any specific problem.

SUMMARY

In one aspect, a method for detecting wear in an implement system of a grading machine may include receiving acceleration information from a sensor connected to the implement system while the grading machine performs a task and estimating an incremental amount of wear in the implement system of the grading machine based on the acceleration information. The method may also include determining a cumulative amount of wear in the implement system of the grading machine and outputting a notification based on the cumulative amount of wear.

In another aspect, a method for detecting wear in an implement system of a grading machine may include receiving a signal from a sensor connected to the implement system of the grading machine, the signal from the sensor being a function of movement of the implement system and estimating an amount of wear in the implement system of the grading machine based on the signal from the sensor, the amount of wear causing one or more components of the implement system to loosen over time. The method may also include outputting a notification based on the estimated amount of wear.

In yet another aspect, a system for detecting wear in a moldboard assembly of a grading machine may include a blade of the moldboard assembly, a drawbar connected to the moldboard assembly, a wear strip connected to the moldboard assembly, and an acceleration sensor connected to the moldboard assembly. The system may also include an electronic control unit configured to receive acceleration information generated with the acceleration sensor and calculate an amount of wear based on the acceleration information. The electronic control unit may also be configured to estimate a timing at which the amount of wear indicates that the wear strip requires replacement or adjustment and generate a notification in response to the estimated timing.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a method or apparatus that comprises a list of elements does not include only those elements, but may include other elements not expressly listed or inherent to such a method or apparatus. In this disclosure, relative terms, such as, for example, "about," "substantially," "generally," and "approximately" are used to indicate a possible variation of ±10% in the stated value or characteristic. In this disclosure, the term "acceleration" is to be broadly interpreted as including both increases in speed and decreases in speed.

Figure 1:
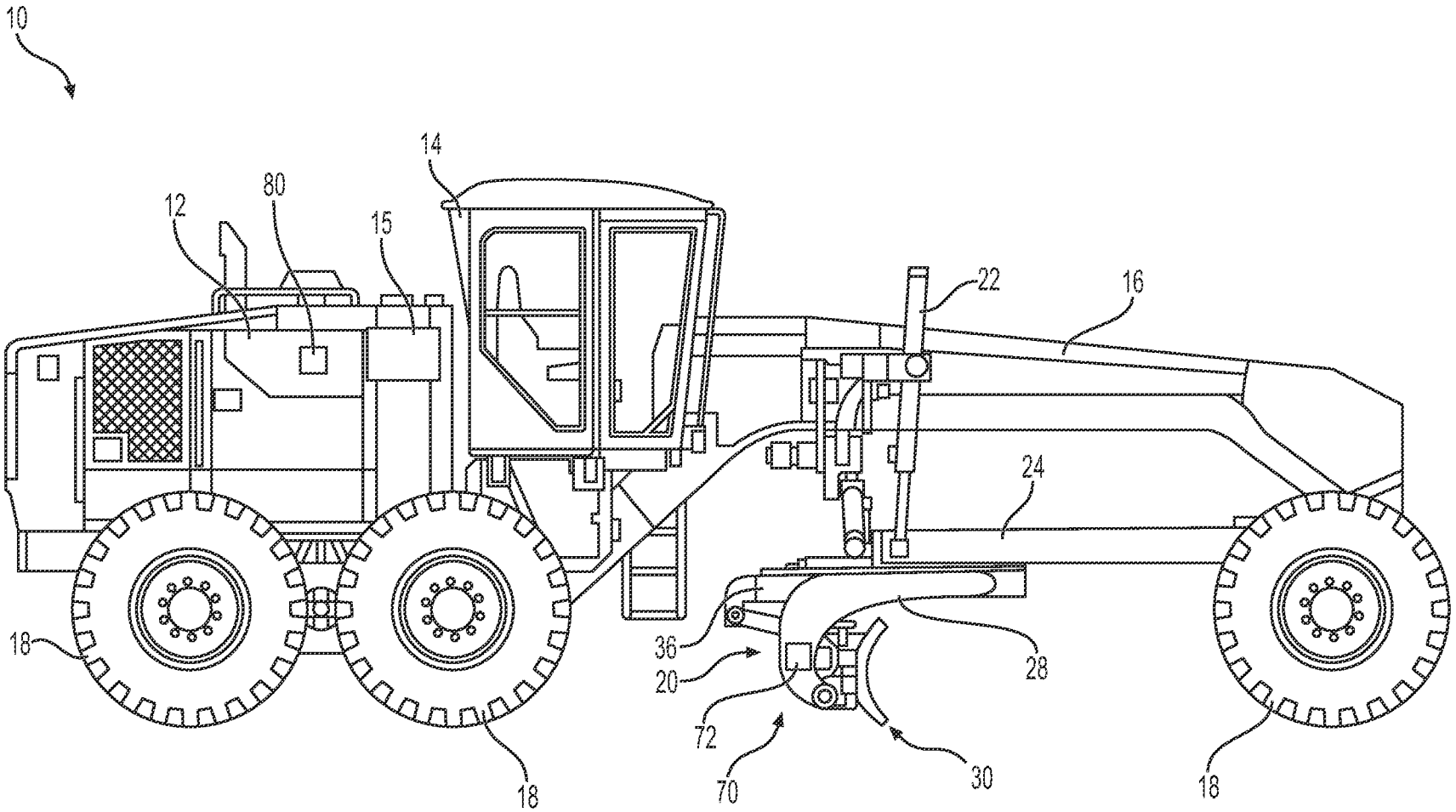
FIG. 1 is a side view of an exemplary grading machine, according to aspects of this disclosure.

FIG. 1 illustrates an exemplary wear detecting system 10 for performing a grading operation. Wear detecting system 10 may include a machine 12, a sensor system 70, and a controller or electronic control unit or electronic control module (ECM) 80. Machine 12 may be an earthmoving machine, such as a motor grader, or another type of machine that engages material with an implement and experiences wear, such as a track-type or wheeled tractor. Machine 12 may include a cabin 14, a frame 16 supported on a machine chassis with cabin 14, ground-engaging devices 18, and an implement system 20. Machine 12 may also include an internal combustion engine 15 or other power-generating device, a hydraulic system for actuating implement system 20, and/or other components that facilitate the operation of system 10.

Cabin 14 of machine 12 may include an operator station that includes controls for operating machine 12. For example, cabin 14 may include input devices that allow an operator to propel machine 12 with ground-engaging devices 18, which may include wheels, as shown in FIG. 1, tracks, or other ground-engaging components. Engine 15 may be configured to combust fuel or otherwise generate power in response to an operator's interaction with these input devices, in order to propel machine 12 and operate implement system 20.

Implement system 20 may include a moldboard assembly 30 and components for supporting moldboard assembly 30 from frame 16, as well as components for positioning moldboard assembly 30. Implement system 20 may include, in addition to moldboard assembly 30, lift cylinders 22, a drawbar 24 connected to lift cylinders 22, one or more support linkages 28 connecting moldboard assembly 30 to drawbar 24, and a circle 36 that enables rotational positioning of moldboard assembly 30. Implement system 20 may also include components for moving moldboard assembly 30 laterally as compared to one or more support linkages 28, such as a sideshift cylinder 38 and associated sideshift rod 40 (shown in FIG. 2).

A sensor system 70 may include one or more sensors for detecting accelerations or other forces, hydraulic fluid pressures, component positions, and/or other types of information relating to machine 12 useful for identifying the occurrence of wear in one or more components of moldboard assembly 30. In some aspects, sensor system 70 may include a sensor that detects information relating to one or more components of moldboard assembly 30 other than blade 32 (e.g., with sensors 71, 72, 73, 74, 75, and/or 78). While FIG. 1 shows a linkage sensor 72 connected to support linkage 28, sensor system 70 may include one or more sensors at other locations (e.g., one or more of the locations illustrated in FIG. 2 and described below), instead of, or in addition to linkage sensor 72. The sensors of sensor system 70 may be in communication with ECM 80 to enable ECM 80 to detect, quantify, and monitor wear. As one example, sensor system 70 may include sensors that facilitate the identification of wear that is associated with looseness of moldboard assembly 30.

ECM 80 may be enabled, via programming, to generate outputs (e.g., outputs 350 shown in FIG. 3) for identifying events associated with wear of implement system 20, including moldboard assembly 30. In particular, ECM 80 may be configured to detect events that contribute to wear of implement system 20 and/or to looseness of one or more components of implement system 20, including moldboard assembly 30. In particular, ECM 80 may be configured to identify events that cause incremental amounts of wear (e.g., wear to moldboard wear strips 42, wear to circle wear strips 44, or to both). ECM 80 may monitor incremental amounts of wear over a period of time, and determine (e.g., calculate) a cumulative amount of wear based on the incremental amounts of wear, each incremental amount of wear estimated with signals from one or more of the sensors of sensor system 70 during the operation of machine 12.

ECM 80 may also be configured, via programming, to identify a remaining useful life of one or more components of implement system 20 based on signals from one or more of the sensors of sensor system 70. While ECM 80 may monitor cumulative wear and identify looseness based on the cumulative wear, ECM 80 may also be configured to immediately identify severe wear or looseness conditions without the need to determine cumulative wear based on a series of estimated incremental amounts of wear. This may be performed, for example, by detecting relatively large forces with sensor system 70. ECM 80 may be further configured to generate one or more outputs, described below, including a notification for display on a device associated with an operator of machine 12, a notification for display at a fleet monitoring system or service center, and/or a notification presented by machine 12 (e.g., via a display present within cabin 14). These notifications may be indicative of a cumulative amount of wear, a remaining useful life of a component of implement system 20, and/or a current looseness condition of moldboard assembly 30.

Figure 3:
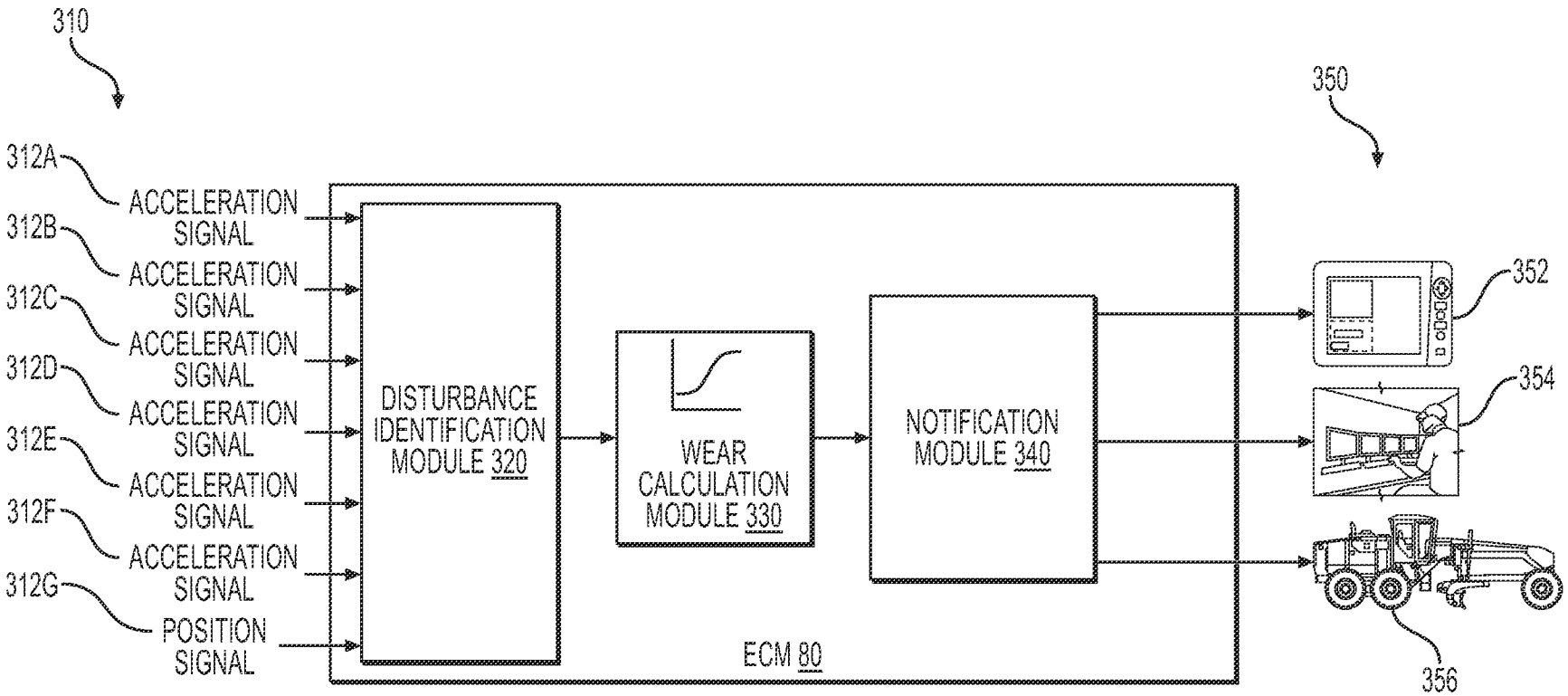
FIG. 3 is a block diagram of an electronic control module, according to aspects of this disclosure.

ECM 80 may embody a single microprocessor or multiple microprocessors that receive inputs 110 (FIG. 3) and generate outputs 130 (FIG. 3). ECM 80 may include a memory, a secondary storage device, a processor such as a central processing unit, or any other means for accomplishing a task consistent with the present disclosure. The memory or secondary storage device associated with ECM 80 may store data and software to allow ECM 80 to perform its functions, including the functions described with respect to FIG. 3 and one or more steps of method 400, described below. Numerous commercially available microprocessors can be configured to perform the functions of ECM 80. Various other known circuits may be associated with ECM 80, including signal-conditioning circuitry, communication circuitry, and other appropriate circuitry.

Figure 2:
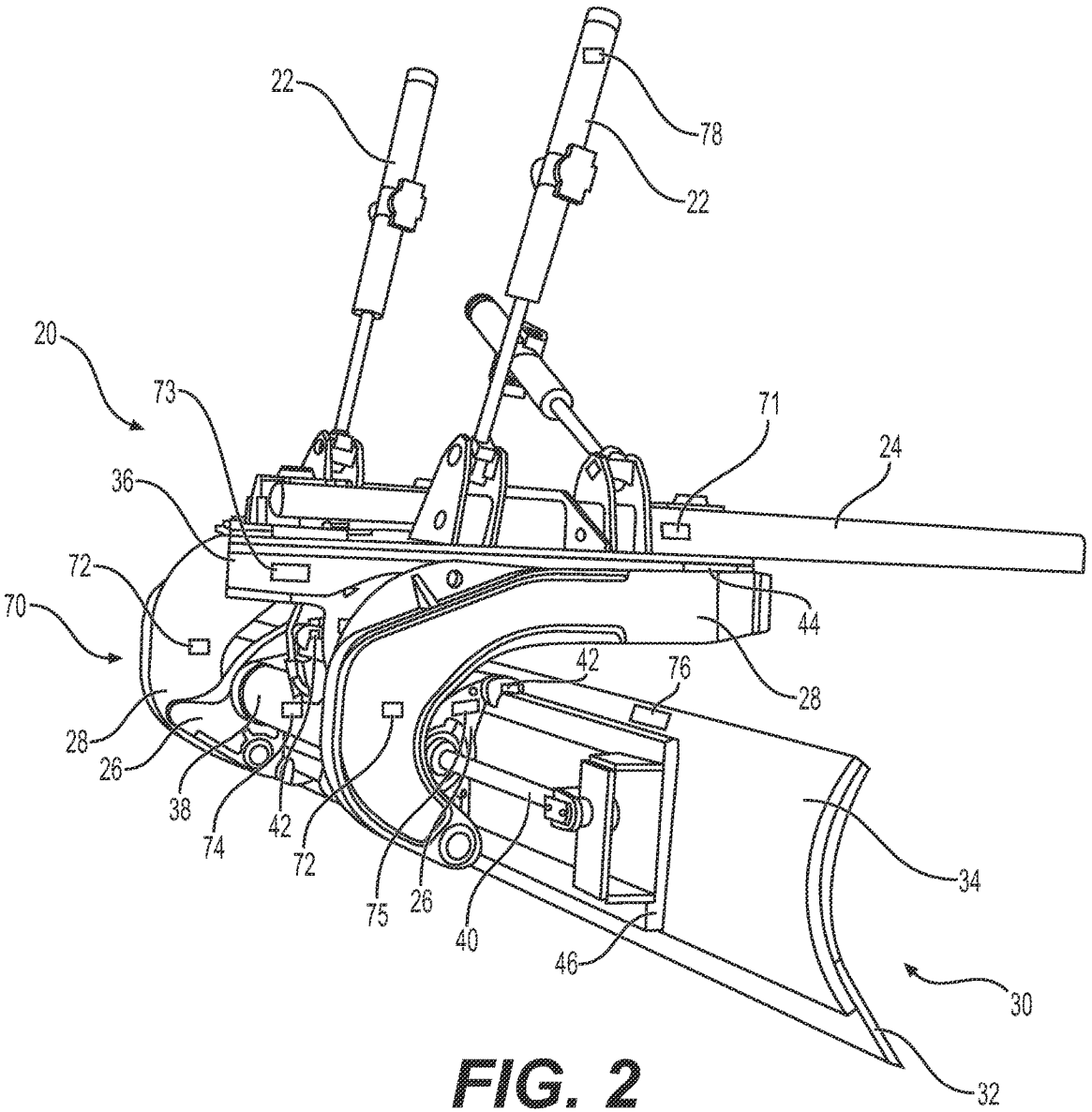
FIG. 2 is a perspective view of a moldboard assembly and monitoring system of the grading machine shown in FIG. 1.

Referring to FIG. 2, moldboard assembly 30 may include a cutting blade 32 having a lower cutting edge, and a backplate 34 which may be a rear surface of blade 32 or a support member on which blade 32 is removably secured. Backplate 34 may include, or may be fastened to, a rear protrusion 46 or one or more rails. Protrusion 46 may connect moldboard assembly 30 to a circle 36 via support linkages 28. Circle 36 may include a large gear configured to rotate with respect to drawbar 24 to enable positioning of moldboard assembly 30 about a vertical axis. A carrier 26 may connect backplate 34 and blade 32 to a horizontally-extending sideshift mechanism, such as a sideshift cylinder 38 that includes a sideshift rod 40.

Implement system 20 may include one or more wear features that are designed as replaceable (e.g., sacrificial) and/or adjustable components, reducing the wear of other components that are larger, more difficult, and more costly to replace or adjust, such as carrier 26, circle 36, etc. For example, one or more moldboard wear strips 42 may be positioned between backplate 34 and support linkages 28. In the example illustrated in FIG. 2, moldboard wear strips 42 may be connected (e.g., removably fixed) to a respective carrier 26. However, in other configurations, one or more moldboard wear strips 42 may be fixed to rear protrusion 46 of backplate 34.

One or more circle wear strips 44 may be connected between circle 36 and drawbar 24, or at other portions of implement system 20 that experience movement, wear strips 44 being secured in a manner that enables periodic replacement or adjustment. Thus, wear strips 44 may reduce the amount of wear experienced by circle 36 and other components of machine 12, such as a yoke plate between circle 36 and drawbar 24. Moldboard wear strips 42 and circle wear strips 44 may include metallic wear strips or shims, composite strips or shims, a stack of metallic and/or composite strips or shims, or other appropriate forms that wear at a faster rate as compared to other components of moldboard assembly 30 such as drawbar 24, circle 36, one or more support linkages 28, etc. While moldboard wear strips 42 and strips 44 are referred to herein as "strips", the term "strips" is not restrictive to a particular shape or thickness. Moldboard wear strips 42, strips 44, or both, may be provided in any suitable shape, such as bars, plates, brackets, arcs, etc., and may be provided as a single member, or as a stack.

Sensor system 70 may include one or more of a drawbar sensor 71, linkage sensor 72, circle sensor 73, sideshift sensor 74 (a sensor connected to sideshift cylinder 38 or adjacent to sideshift cylinder 38), carrier sensor 75, moldboard sensor 76, and a cylinder sensor 78. Sensors 71, 72, 73, 74, 75, 76 and/or 78 may be one or more accelerometers or other device configured to detect disturbances, such as sudden accelerations or decelerations. Sensors 71-76 and 78 may include one or more inertial measurement units (IMUs) that include accelerometers that measure forces in three axes, including a first horizontal axis (x-axis), a second horizontal axis (y-axis), and a vertical direction (z-axis). If desired, sensors 71-76 and 78 may also be configured to detect rotation about the x-, y-, and z-axes. Sensors associated with hydraulic components, such as sensors 74 and 78, may be position sensors or pressure sensors configured to detect a pressure of hydraulic fluid supplied to a hydraulic cylinder such that sensors 74 and 78 can detect unexpected movements or force placed on lift cylinders 22 or sideshift cylinder 38.

Drawbar sensor 71 may be fixed to drawbar 24 to measure disturbances that are transferred from moldboard assembly 30 to drawbar 24, or other disturbances experienced by machine 12. Similarly, linkage sensors 72 may be fixed to a respective support linkage 28, circle sensor 73 may be fixed to circle 36, carrier sensor 75 may be fixed to a carrier 26, and moldboard sensor 76 may be fixed to a component of moldboard 30, such as a backplate 34. Sensors 74 and 78 may be connected directly to a hydraulic cylinder to measure changes in a position of the cylinder, or may be connected to supply of hydraulic fluid (not shown) to measure pressure spikes in the hydraulic fluid.

FIG. 3 is a block diagram illustrating an exemplary configuration of ECM 80. As shown in FIG. 3, ECM 80 may be programmed or otherwise configured with a disturbance identification module 320, a wear calculation module 330, and a notification module 340. ECM 80 may receive a plurality of inputs 310, including inputs from the one or more sensors of sensor system 70. ECM 80 may be configured to generate one or more outputs 350 which enable ECM 80, via notification module 340, to communicate a wear condition of implement system 20, communicate a loose condition of implement system 20, and/or communicate a remaining useful life of implement system 20. ECM 80 may be a standalone controller dedicated to monitoring wear, or may generate outputs for controlling one or more other systems of machine 12, such as an internal combustion engine, hydraulic system, etc.

Inputs 310, including signals 312A-312G, may be received and processed with disturbance identification module 320 of ECM 80. Signals 312A-312F may be acceleration signals generated by sensors 71, 72, 73, 74, 75, and 76, respectively. Signals 312A-312F may include acceleration information for a plurality of different axes, such as the above-described x-, y-, and z-axes. If desired, signals 312A-312F may include acceleration information for rotation about one or more of these axes. Position signal 312G may be an absolute position signal, that represents a position of a hydraulic component of implement system 20. In particular, position signal 312G may indicate a position of a movable component (e.g., a rod) of one or more lift cylinders 22, sideshift cylinder 38, or another hydraulic component of implement system 20. If desired, one or more of signals 312A-312F may be a position signal, instead of or in addition to an acceleration signal. For example, signal 312A may include a position signal indicative of a position of drawbar 24. One or more of signals 312A-312G may be a pressure signal indicative of a pressure of hydraulic fluid. Thus, signals 312A-312G may be configured to indicate wear that occurs when hydraulic fluid increases unexpectedly.

Disturbance identification module 320 may be configured to identify wear events, or disturbances, indicated by one or more of signals 312A-312G. In one aspect, disturbance identification module 320 may receive one or more of signals 312A-312G to identify a wear event according to the magnitude and/or direction indicated by these signals. For example, disturbance identification module 320 may determine that a wear event has occurred when an acceleration in any one or more axes (e.g., the above-described x-, y-, and/or z-axes) exceeds a predetermined threshold value. Additionally or alternatively, disturbance identification module 320 may be configured to determine that a disturbance, also referred to herein as a wear event, has occurred when acceleration is detected in a particular axis, such as a vertical or z-axis, while ignoring other axes (e.g., a horizontal axis in which acceleration tends to occur when moving material at a steady rate). In other configurations, disturbance identification module 320 may determine that wear has occurred based on accelerations in multiple axes. For example, disturbance identification module 320 may identify the occurrence of wear when a sensed vertical acceleration exceeds a vertical threshold value, when a sensed horizontal acceleration exceeds a horizontal threshold value, or when both accelerations exceed their respective threshold values. In some configurations, vertical and horizontal thresholds may be different from each other. For example, the vertical threshold value may be lower (e.g., a requiring a smaller amount of acceleration to trigger identification of a disturbance) in comparison to a horizontal threshold.

In configurations where disturbance identification module 320 is configured to determine the occurrence of a disturbance, or wear event, based on position signal 312G, module 320 may estimate wear based on the position of hydraulic cylinder (e.g., by calculating the rate at which this position changes). In these or other configurations, disturbance identification module 320 may be configured to identify, based on position signal 312G, when a position of a hydraulic cylinder changes in the absence of the issuance of a command to cause this change of position. In configurations where signal 312G is provided as a pressure signal that indicates a pressure of hydraulic fluid, disturbance identification module 320 may monitor this signal for a pressure spike in the hydraulic fluid (e.g., a pressure value that exceeds a predetermined threshold).

Wear calculation module 330 may be configured to estimate a severity of wear events that are identified by disturbance identification module 320. For example, wear calculation module 330 may be configured to receive a magnitude and/or direction of acceleration from disturbance identification module 320, when module 320 identifies the occurrence of a wear event. Wear calculation module 330 may include one or more maps, look-up tables, or other data-storing structures, that enable the estimation of an incremental amount of wear. For example, wear calculation module 330 may be configured to determine a severity or magnitude of an incremental amount of wear based on the magnitude and direction of an impact represented by one or more of signals 312A-312G.

Wear calculation module 330 may also be configured to monitor a cumulative amount of wear that represents the total amount of wear that has been experienced by one or more components of implement system 20. For example, the cumulative amount of wear may represent the sum of the incremental amounts of wear. The cumulative amount of wear may represent a "replacement wear" that can be addressed by replacing one or more components associated with this wear. When replacement is performed, the cumulative amount of wear, in this example, replacement wear, may be reset (e.g., set to a value of zero) by performing a "replacement reset" operation each time a monitored component of implement system 20 is replaced. ECM 80 may be notified that a monitored component has been replaced by a user interaction with an input device of machine 12 or by interacting with any other device associated with machine 12, including any of the devices that receive one or more of outputs 350.

If desired, the cumulative amount of wear may represent an "adjustment wear" that can be addressed by performing an adjustment to one or more components of implement system 20, without the need to replace the component. An adjustment may include tightening a loose component or changing a position of a component, for example. The cumulative amount of wear (adjustment wear) may be reset by performing an "adjustment reset" operation after the adjustment is performed. In some aspects, wear calculation module 330 may track replacement wear (for components that are replaced when wear reaches a particular amount) separately from adjustment wear (for components that are adjusted when wear reaches a particular amount). Replacement wear and adjustment wear may be monitored for different components such that replaceable components are associated with a replacement wear and adjustable components are associated with an adjustment wear. However, in at least some configurations, a single component or group of components, such as wear strips 42 and/or 44, may be adjusted one or more times before being replaced and may be associated with both an adjustment wear that is reset using an adjustment reset operation, and a replacement wear that is reset with a replacement reset operation. The adjustment wear may therefore be independent of the replacement wear for the same component.

Notification module 340 may be configured to receive the incremental amount of wear from wear calculation module 330. Based on this incremental amount of wear or based on a severity of a single wear event, notification module 340 may be configured to output a notification. This notification may be generated, from ECM 80, to one or more of an operator display, service center, or machine 12 itself. In particular, notification module 340 may be configured to generate one or more notifications, as outputs 350, the notifications including an operator display notification 352 (e.g., a notification displayed on a display within cabin 14 of machine 12, a personal device associated with the operator such as a cellular phone or other handheld device, tablet, laptop, remote computing system, etc.), and/or a management notification 354 (e.g., a portable or stationary computing system monitored by an entity other than an operator located on-site with machine 12, such as a fleet manager, supervisor, service center etc.). If desired, outputs 350 may include a machine command 356, which may cause a particular action of machine 12 to prevent damage. As one example, machine command 356 may include raising moldboard assembly 30 with lift cylinders 22 to prevent cutting blade 32 from encountering material.

Notification module 340 may be configured to receive the cumulative amount of wear and compare the cumulative amount of wear to a threshold amount of wear. As described above, the cumulative amount of wear may represent a replacement wear and/or an adjustment wear. When monitoring replacement wear, the threshold amount of wear may represent an amount of wear at which it is desirable or required to replace moldboard wear strip 42 and/or circle wear strip 44. When monitoring adjustment wear, the threshold amount of wear may represent an amount of wear at which one or more components should be adjusted. For each type of wear, the threshold amount of wear may be the maximum permitted amount of wear, or an amount of wear approaching the maximum permitted amount of wear. In the case of replacement wear, the threshold amount of wear may correspond to an amount of wear at which strip 42 and/or strip 44, for example, have no remaining useful life or little remaining useful life. When a plurality of different components are monitored, such as moldboard wear strips 42 and strips 44, each component may have a different cumulative amount of wear associated with it, such that these components are monitored independent of each other and such that replacement and independent wear are monitored separately for each component. In these configurations, notification module 340 may output a notification 352 and/or 354 based on the monitored component with the lower remaining useful life. Additionally, notification 352 and/or 354 may indicate the type of wear being monitored or the type of action (e.g., an adjustment or replacement) that should be performed.

When wear members, such as strips 42 and/or 44, are worn (e.g., have experienced significant material loss) so as to have no or little remaining useful life, the cumulative wear and associated loss of material may tend to cause looseness in one or more components of moldboard assembly 30. For example, wear in strips 42 and/or 44 may cause looseness of blade 32 or other parts of moldboard assembly 30. Thus, notification module 340 may be configured to output a notification (e.g., operator display notification 352 and/or management notification 354) that is based on the identification of looseness in moldboard assembly 30, according to a wear threshold associated with the component of assembly 20 that wears at the fastest rate (e.g., strips 42 and/or 44).

If desired, notification module 340 may also be configured to determine a remaining useful life of one or more components of assembly 20 (including determining the remaining useful life of assembly 20 as a whole) based on the difference between the cumulative amount of wear and the threshold amount of wear. The remaining useful life may be notified and displayed as a percentage (e.g., an amount of remaining life and/or an amount of useful life that has been consumed). Additionally or alternatively, the remaining useful life may be notified and displayed as an amount of operating time (e.g., an estimated remaining number of operating hours before the remaining useful life is exhausted and/or replacement or adjustment is recommended). Thus, the remaining useful life may be prognostic, indicating a remaining amount of operating time (e.g., 48 hours, 24 hours, 12 hours, 100%, 50%, 25%, etc.), or diagnostic when little or no remaining useful life is present (e.g., a notification indicating the presence of looseness). Each of these notifications, whether prognostic or diagnostic, may correspond to an estimation of timing at which an amount of wear corresponds to the need to replace or adjust one or more components of assembly 20.

If desired, notification module 340 may be configured to generate one or more outputs 350 based on an instantaneous amount of wear calculated with wear module 330. For example, disturbance identification module 320 may receive one or more signals 312A-312G that, when evaluated by wear calculation module 330, indicate a large amount of wear and/or looseness in moldboard assembly 30. This may enable notification module 340 to generate one or more of outputs 350 when a single measurement, or a series of measurements taken over a relatively short period of time (e.g., measurements taken with sensor system 70 over a period of time that is less than 24 hours, less than 12 hours, or less than 1 hour), indicates the existence of a relatively large amount of wear and/or a loose moldboard assembly 30. Thus, in some aspects, ECM 80 may be configured to identified a damaged and/or improperly installed moldboard assembly 30, or identify a component with no remaining useful life, independent of a cumulative amount of wear.

INDUSTRIAL APPLICABILITY

Wear detecting system 10, including sensor system 70 and ECM 80 may be useful in any machine that includes an implement that is subject to wear, such as a motor grader having a moldboard, as shown in FIG. 1, dozers, or other earthmoving machines. System 10 may also be employed in other systems that experience regular wear, such as other types of machines or vehicles (e.g., hauling trucks, tractors, excavators, etc.). System 10 may monitor wear continuously or intermittently during the operation of machine 12, and may store and retrieve wear conditions (e.g., a cumulative amount of wear), such that wear can be tracked in one or more components of machine 12 over a multiple operations, tasks, or jobs. Further, system 10 may be measure and identify wear in real-time or near-time.

Figure 4:
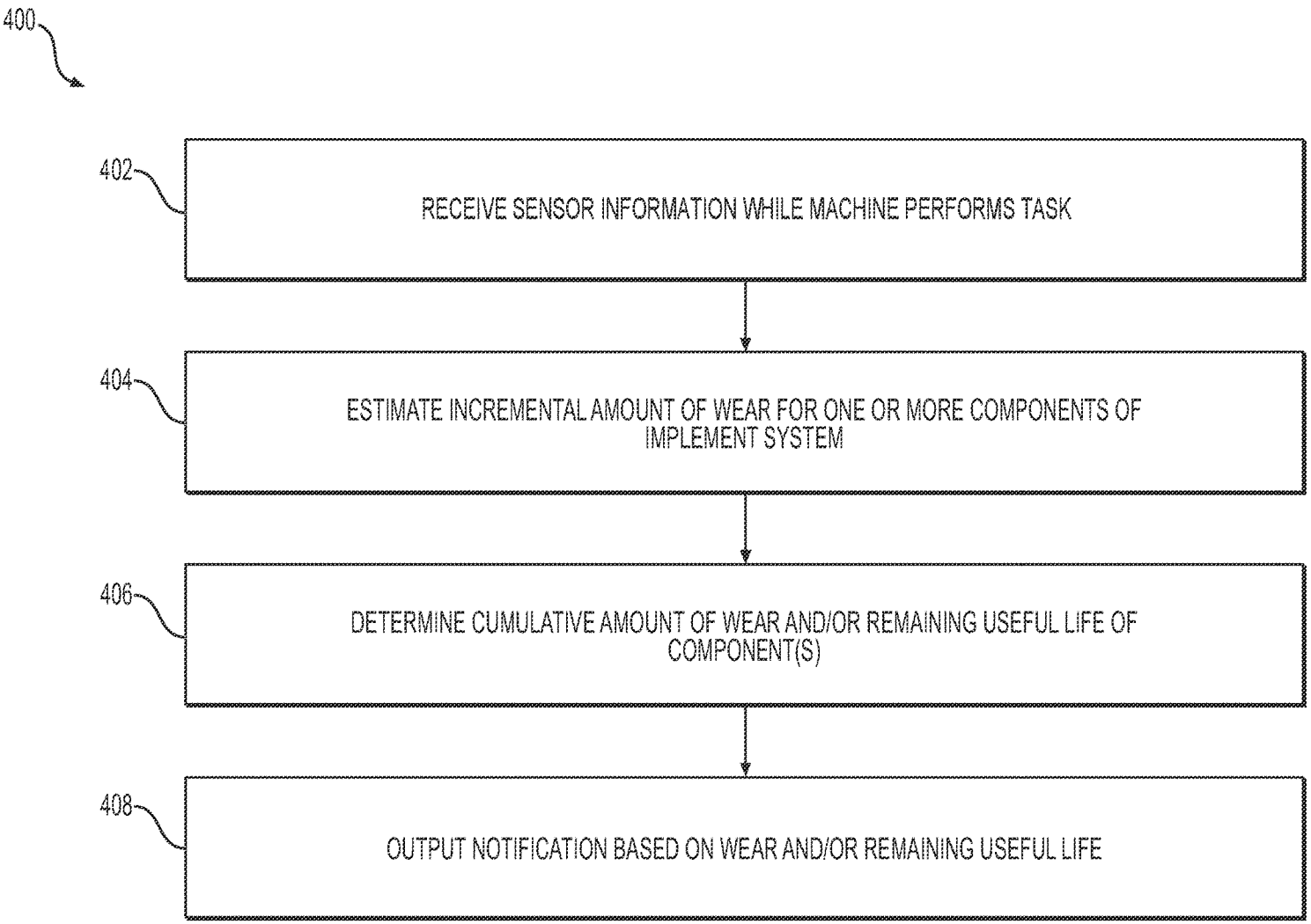
FIG. 4 is a flowchart depicting an exemplary method for detecting wear in an implement system, according to aspects of the disclosure.

FIG. 4 is a flowchart illustrating an exemplary method 400 for detecting wear in an implement system of a machine, such as grading machine 12. Method 400 may be performed while machine 12 performs a grading operation. For example, ECM 80 may perform steps 402, 404, 406, and 408 during an earthmoving job, such as grading, while the machine performs a task or travels. Alternatively, method 400 may be performed intermittently at regular irregular intervals. When method 400 is performed during grading, method 400 may enable real time or near-real time monitoring without the need to discontinue propulsion of machine 12 and without the need to place implement(s) of machine 12 in a specific position. Thus, method 400 may enable detection of wear events as they occur, facilitating the generation of outputs 350 in a timely manner. If desired, method 400 may be performed while commanding blade 32 of moldboard assembly 30 to remain in a constant position as compared to machine 12.

A step 402 of method 400 may include receiving sensor information, with ECM 80, from sensor system 70. This sensor information may be received by ECM 80 during the operation of machine 12, and in particular, during a grading operation during which machine 12 is propelled by an engine or other power source such that wheels, tracks, or other ground-engaging devices 18 allow machine 12 to traverse a worksite. Step 402 may include performing a task, such as earthmoving work, by operating implement system 20 to perform grading while machine 12 is propelled.

A step 404 may include estimating one or more incremental amounts of wear with ECM 80 based on signals received from sensor system 70. An incremental amount of wear may be estimated each time one or more signals from sensor system 70, such as signals 312A-312G, include information indicative that a wear event has occurred. For example, wear calculation module 330 may determine that a wear event has occurred when an acceleration indicated by one or more of signals 312A-312F is greater than a predetermined threshold and/or when position signal 312G identifies the presence of an unexpected force applied to a hydraulic component, as described above. Step 404 may include estimating wear based on the direction in which the acceleration or force is measured. For example, step 404 may include determining, with disturbance identification module 320, that wear has occurred based on the direction of the acceleration or movement. In one example, step 404 may include determining that wear has occurred when the force and/or movement identified with sensor system 70 is in a vertical direction (e.g., a z-axis, as described above). The severity of the wear and the corresponding magnitude of the incremental amount of wear may be estimated by retrieving one or more wear values from a look-up table, map, etc., based on the measured magnitude and/or direction of acceleration or movement detected with sensor system 70.

A step 406 of method 400 may include determining a cumulative amount of wear, a remaining useful life, or both, of the component(s) monitored with ECM 80. The cumulative amount of wear may be determined by periodically updating a running value, calculated with wear calculation module 330 of ECM 80, that represents the amount of wear (e.g., replacement wear or adjustment wear) that has accrued in implement system 20. This wear may be monitored over a plurality of different operations of wear detecting system 10. Step 406 may include determining the remaining useful life of implement system 20, and in particular, determining that remaining useful life has been exhausted, when the cumulative amount of wear exceeds this threshold. This determination may include identifying looseness in moldboard assembly 30 due to little or no remaining useful life of implement system 20, and may indicate that a current time exceeds the estimated time at which a component of implement system 20 requires replacement or adjustment. Additionally or alternatively, step 406 may include identifying a lack of remaining useful life (e.g., looseness in moldboard assembly 30) based on an instantaneous amount of wear measured with wear calculation module 330 in step 404.

A step 408 may include outputting a notification based on the cumulative amount of wear and/or in response to determining that the remaining useful life of implement system 20 has been exhausted or has been depleted below a predetermined threshold. The notification may be generated as one or more of outputs 350, and may be transmitted to an offsite monitoring system, e.g., as operator display notification 352 and/or management notification 354 sent to an offsite device. In methods where wear detecting system 10 monitors wear of multiple components, such as moldboard wear strips 42 and circle wear strips 44, the notification may indicate which component is associated with the notification.

While steps 402, 404, 406, and 408 have been described in an exemplary sequence, as understood, one or more of these steps may be performed simultaneously or performed and/or repeated in a different order. Moreover, any two or more of these steps may be performed simultaneously and/or at overlapping periods of time. As discussed above, each of these steps may be performed while machine 12 is in motion.

The system and method disclosed herein may facilitate accurate identification of wear conditions of wear materials in a machine, such as a motor grader. The prompt identification of wear material that has used a significant amount of life may enable timely maintenance, preventing rework and improving efficiency. Identification of implement system wear and/or blade looseness can ensure that the machine, such as motor grader, maintains tight grade tolerances. The system and method may facilitate real-time wear tracking, or immediate identification of looseness, enabling timely maintenance and reducing machine downtime.

It will be apparent to those skilled in the art that various modifications and variations can be made to the disclosed system and method without departing from the scope of the disclosure. Other embodiments of the system and method will be apparent to those skilled in the art from consideration of the specification and system and method disclosed herein. It is intended that the specification and examples be considered as exemplary only, with a true scope of the disclosure being indicated by the following claims and their equivalents.

What is claimed is:

1. A method for detecting wear in an implement system of a grading machine, the method comprising:

with at least one processor:

receiving acceleration information from a sensor connected to the implement system while the grading machine performs a task that causes an incremental amount of wear in the implement system;

estimating, based on the acceleration information, the incremental amount of wear in the implement system of the grading machine;

determining, based on the estimated incremental amount of wear, a cumulative amount of wear in the implement system of the grading machine; and outputting a notification based on the cumulative amount of wear; and performing replacement or adjustment of the implement system based on the output notification.

2. The method of claim 1, wherein the incremental amount of wear and the cumulative amount of wear are both associated with a component of the implement system connected to a cutting blade and to a drawbar.

3. The method of claim 2, wherein the component of the implement system is a wear strip.

4. The method of claim 1, wherein the sensor is connected to a drawbar, a circle, a support linkage, a sideshift mechanism, or a moldboard.

5. The method of claim 4, wherein the sensor is an accelerometer configured to detect acceleration in at least a horizontal direction and a vertical direction.

6. The method of claim 5, wherein the incremental amount of wear is estimated based on an acceleration in the vertical direction that is detected with the accelerometer.

7. The method of claim 1, wherein the receiving comprises receiving the acceleration information from the sensor connected to the implement system while the grading machine performs the task of grading a worksite.

8. A method for detecting wear in an implement system of a grading machine, the method comprising:

with at least one processor:

receiving a signal from a sensor connected to the implement system of the grading machine, the signal from the sensor being a function of movement of the implement system which causes wear to the implement system;

estimating an amount of wear in the implement system of the grading machine based on the signal from the sensor, the amount of wear causing one or more components of the implement system to loosen over time; and outputting a notification based on the estimated amount of wear; and performing maintenance of the implement system based on the output notification.

9. The method of claim 8, wherein the amount of wear is estimated based on a magnitude and direction indicated in the signal from the sensor.

10. The method of claim 8, wherein the one or more components of the implement system includes a moldboard.

11. The method of claim 8, wherein the sensor is connected to or connected adjacent to a sideshift cylinder of the grading machine.

12. A method for detecting wear in a moldboard assembly of a grading machine with a system comprising:

a blade of the moldboard assembly, a drawbar connected to the moldboard assembly, a wear strip connected to the moldboard assembly, an acceleration sensor connected to the moldboard assembly, and an electronic control unit, the method comprising:

with the electronic control unit:

receiving acceleration information generated with the acceleration sensor, the acceleration information indicating that an acceleration of the moldboard assembly exceeds a predetermined acceleration during a task that causes wear to the moldboard assembly, calculating an amount of wear based on the acceleration information, estimating a timing at which the amount of wear indicates that the wear strip requires replacement or adjustment based on the calculated amount of wear, and generating a notification in response to the estimated timing; and replacing or adjusting the wear strip based on the generated notification.

13. The method of claim 12, wherein the notification indicates a need to replace or adjust the wear strip, the wear strip being connected between the blade and a support linkage for supporting the blade.

14. The method of claim 12, wherein the estimating comprises estimating the timing based on a direction of acceleration measured with the acceleration sensor.

15. The method of claim 12, wherein the amount of wear is calculated based on the acceleration information including acceleration in a vertical direction which is detected with the acceleration sensor.

16. The method of claim 12, wherein the calculating comprises calculating the amount of wear of the blade of the moldboard assembly while commanding the blade to remain in a constant position.

17. The method of claim 12, wherein the notification indicates the estimated timing at which the wear strip will require replacement or adjustment.

18. The method of claim 12, wherein the generating the notification comprises generating the notification and transmitting the notification to an operator device.

19. The method of claim 12, wherein the generating the notification comprises generating the notification and transmitting the notification to an offsite monitoring system.

20. The method of claim 12, wherein the electronic control unit is configured to generate a command to control a position of the moldboard assembly when a current timing exceeds the estimated timing.

* * * * *